US008157560B2

(12) United States Patent
Stires

(10) Patent No.: US 8,157,560 B2
(45) Date of Patent: Apr. 17, 2012

(54) HEATER

(75) Inventor: Charles Randolph Stires, Barnhart, MO (US)

(73) Assignee: HY-C Company LLC, St. Louis, MO (US)

( * ) Notice: Subject to any disclaimer, the term of this patent is extended or adjusted under 35 U.S.C. 154(b) by 59 days.

(21) Appl. No.: 12/750,310

(22) Filed: Mar. 30, 2010

(65) Prior Publication Data

US 2011/0244408 A1 Oct. 6, 2011

(51) Int. Cl.
*F24H 9/20* (2006.01)

(52) U.S. Cl. ..... 431/20; 431/21; 126/77; 126/112

(58) Field of Classification Search ..... 431/20, 431/21; 126/77, 112, 312; 49/1, 7, 8, 141
See application file for complete search history.

(56) References Cited

U.S. PATENT DOCUMENTS 3,337,991 A 8/1967 Adams
3,643,582 A 2/1972 Mochida
3,777,422 A 12/1973 Janssen
3,830,016 A 8/1974 Levine
4,090,437 A 5/1978 Bogaert
4,146,048 A 3/1979 McCabe
4,201,185 A * 5/1980 Black ..... 126/77
4,226,225 A 10/1980 Niedermeyer
4,409,956 A 10/1983 Barnett
4,461,274 A 7/1984 Cauffman
4,858,517 A * 8/1989 Coker ..... 454/184
5,927,012 A 7/1999 Cermola et al.

OTHER PUBLICATIONS

Charmaster brochure, at least as early as Mar. 30, 2010, pp. 10-12.
Embers Ductbox Assembly Instructions, at least as early as Mar. 30, 2010, 10 pages.
Embers Specifications from Charmaster.com website, as early as Feb. 18, 2008, 1 page.

* cited by examiner

*Primary Examiner* — Alfred Basichas
(74) *Attorney, Agent, or Firm* — Senniger Powers LLP

(57) ABSTRACT

A heater including a heat dump opening and a heat dump cover moveable between an open and a closed position to selectively block flow of fluid through the heat dump opening. The heat dump opening is formed in the top of the housing, and the heat dump cover is biased toward the open position. The cover moves to an open position in response to a sensed preselected limit temperature to vent excessively heated air to ambient to prevent damage to the heater and a duct system and a building to which the heater may be connected. Air escaping the heater via the heat dump opening may cause replacement air to be drawn into the heater to cool the heater, including electrical components of the heater located near an inlet and an outlet of the heater.

20 Claims, 8 Drawing Sheets

HEATER

FIELD OF THE INVENTION

The present invention generally relates to a heater, and more particularly to a heater having a heat dump opening.

BACKGROUND

Heaters or furnaces are commonly used to heat fluid, such as air, circulated through a building to heat its interior. Some heaters burn solid fuel, such as wood or coal. Such heaters generally include a fire box in which the fuel is burned. Air is circulated to and from the heater via a duct system generally including a cold air duct and a hot air duct communicating with the building. The heater receives air from the building via the cold air duct. The air is heated as it flows over the fire box in a heat exchanger portion of the heater. The heated air is returned to the building via the hot air duct to heat the interior of the building.

Conventional heaters of this type include electrical components used for regulating the heater. One such electrical component is a main electrical control used to control overall operation of the heater. Other electrical components include a blower for circulating air within the heater to move the air over the fire box and a blower limit switch turning the blower on when temperature in the heater exceeds a predetermined threshold.

In various circumstances, the heater may become too hot, potentially damaging the heater, including its electrical components, and ultimately the duct system and the building. The excessively heated air may result from the electrical components losing power or malfunctioning. For example, if the blower malfunctions, air may not be blown over the fire box, resulting in heat buildup inside the heater. To prevent damage, it is desirable to automatically "dump" or release excessively heated air from the heater.

Some heaters include automatic systems for releasing hot air when overheating. In one prior art heater, a thermal sensor and a heat dump opening are provided to release hot air from the hot air duct when temperature in the duct exceeds a predetermined value.

SUMMARY

One aspect of the present invention relates to a heater for heating a fluid that includes a housing having a top, a side, a hollow interior defined at least in part by the top and the side, an inlet permitting fluid to enter the interior, an outlet permitting fluid to exit the interior, and a heat dump opening formed in the housing. The heater includes a fire box positioned in the hollow interior of the housing for burning a thermal source to heat fluid inside the hollow interior of the housing. The heater also includes a heat dump cover that selectively blocks the heat dump opening. The heat dump cover is moveable between a closed position in which the heat dump opening is blocked to prevent fluid from exiting the interior through the heat dump opening and an open position in which the heat dump opening is unblocked to permit fluid to exit the interior through the heat dump opening. The cover is biased toward the open position. The heater also includes a latch that is operatively connected to the heat dump cover. The latch includes a thermal sensor that is positioned for sensing temperature directly above the fire box. The latch permits the heat dump cover to move toward its open position when a temperature sensed by the thermal sensor exceeds a preselected limit temperature, permitting fluid to exit the hollow interior of the housing through the heat dump opening to reduce temperature increase in the interior.

In another aspect of the invention, a heater for heating a fluid includes a housing that has a top, a side, a hollow interior defined at least in part by the top and the side, an inlet permitting fluid to enter the interior, an outlet permitting fluid to exit the interior, and a heat dump opening formed in the top of the housing. The heater includes a fire box positioned in the hollow interior of the housing for burning a thermal source to heat fluid inside the hollow interior of the housing. The heater also includes a heat dump cover that selectively blocks the heat dump opening and is moveable between a closed position in which the heat dump opening is blocked to prevent fluid from exiting the interior through the heat dump opening and an open position in which the heat dump opening is unblocked to permit fluid to exit the interior through the heat dump opening. The cover is biased toward the open position. The heater also includes a latch that is operatively connected to the heat dump cover. The latch includes a thermal sensor for sensing temperature in the hollow interior. The latch permits the heat dump cover to move toward its open position when a temperature sensed by the thermal sensor exceeds a preselected limit temperature, permitting fluid to exit the hollow interior of the housing through the heat dump opening to reduce temperature increase in the interior.

In another aspect of the invention, a heater for heating a fluid includes a housing having a top, a side, a hollow interior defined at least in part by the top and the side, an inlet permitting fluid to enter the interior, an outlet permitting fluid to exit the interior, and a heat dump opening formed in the housing. The heater includes a fire box that is positioned in the hollow interior of the housing for burning a thermal source to heat fluid inside the hollow interior of the housing. The heater also includes a heat dump cover that selectively blocks the heat dump opening and is moveable between a closed position in which the heat dump opening is blocked to prevent fluid from exiting the interior through the heat dump opening and an open position in which the heat dump opening is unblocked to permit fluid to exit the interior through the heat dump opening. A spring is connected to the heat dump cover for biasing the cover toward the open position. A latch is operatively connected to the heat dump cover. The latch includes a thermal sensor for sensing temperature in the hollow interior. The latch permits the heat dump cover to move toward its open position when a temperature sensed by the thermal sensor exceeds a preselected limit temperature, permitting fluid to exit the hollow interior of the housing through the heat dump opening to reduce temperature increase in the interior.

In another aspect of the invention, a heater for heating a fluid includes a housing that has a top, a side, a hollow interior defined at least in part by the top and the side, an inlet permitting fluid to enter the interior, an outlet permitting fluid to exit the interior, and a heat dump opening formed in the housing. The heater includes a blower limit control that is mounted in the hollow interior of the housing adjacent the outlet. The heater also includes a main electrical control that is mounted in the hollow interior of the housing adjacent the inlet. A fire box is positioned in the hollow interior of the housing for burning a thermal source to heat fluid inside the hollow interior of the housing. A heat dump cover selectively blocks the heat dump opening and is moveable between an open position in which the heat dump opening is blocked to prevent fluid from exiting the interior through the heat dump opening and a closed position in which the heat dump opening is unblocked to permit fluid from exiting the interior through the heat dump opening. A latch is operatively connected to the heat dump cover. The latch includes a thermal sensor for sensing temperature in the hollow interior. The latch permits the heat dump cover to move toward its open position when a temperature sensed by the thermal sensor exceeds a preselected limit temperature, permitting fluid to exit the hollow interior of the housing through the heat dump opening to reduce temperature increase in the interior. The fluid exits the hollow interior of the housing through the heat dump opening drawing replacement fluid into the hollow interior through the inlet to cool the main electrical control and through the outlet to cool the blower limit control.

In yet another aspect of the present invention, a wood heater for heating air includes a housing that has a top, a side, a hollow interior defined at least in part by the top and the side, an inlet permitting air to enter the interior, an outlet permitting air to exit the interior, and a heat dump opening formed in the top of the housing. The wood heater includes a fire box that is positioned in the hollow interior of the housing for burning wood to heat air inside the hollow interior of the housing. The wood heater also includes a heat dump cover selectively blocking the heat dump opening and moveable between a closed position in which the heat dump opening is blocked to prevent air from exiting the interior through the heat dump opening and an open position in which the heat dump opening is unblocked to permit air to exit the interior through the heat dump opening. A spring connected to the heat dump cover biases the cover toward the open position. A latch is operatively connected to the heat dump cover. The latch includes a thermal sensor positioned for sensing temperature directly above the fire box. The latch permits the heat dump cover to move toward its open position when a temperature sensed by the thermal sensor exceeds a preselected limit temperature, permitting air to exit the hollow interior of the housing through the heat dump opening to reduce temperature increase in the interior.

BRIEF DESCRIPTION OF THE DRAWINGS

Corresponding reference characters indicate corresponding parts throughout the drawings.

DETAILED DESCRIPTION OF THE DRAWINGS

Figure 1:
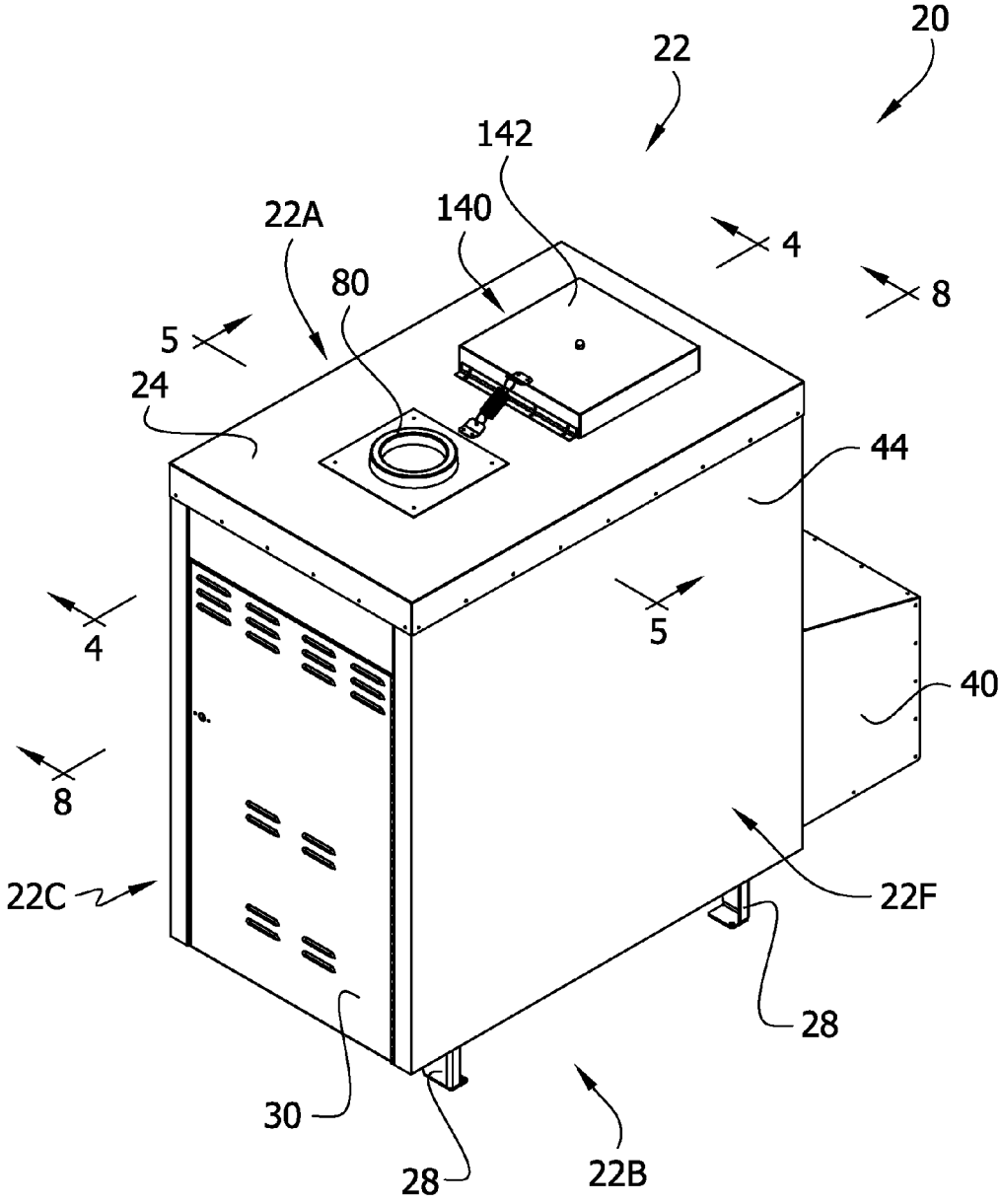
FIG. 1 is a front perspective of one embodiment of a heater according to the present invention.

Referring to FIG. 1, a heater or furnace according to the present invention is designated generally by the reference number 20. The heater 20 is used to heat a fluid that is circulated through a building (not shown) to heat an interior of the building. The heater 20 heats the fluid by burning a thermal source or fuel. The illustrated heater 20 is an outdoor forced-air heater configured for burning wood. As described in further detail below, the heater 20 automatically heats air and circulates the air to heat the interior of the building. If excessively heated air is sensed within the heater 20, the heater automatically releases or "dumps" hot air from the heater to prevent damage to the heater and the building. Other types of heaters such as indoor heaters, heaters that burn a different type of fuel, and heaters that heat other fluids are within the scope of the present invention.

Figure 2:
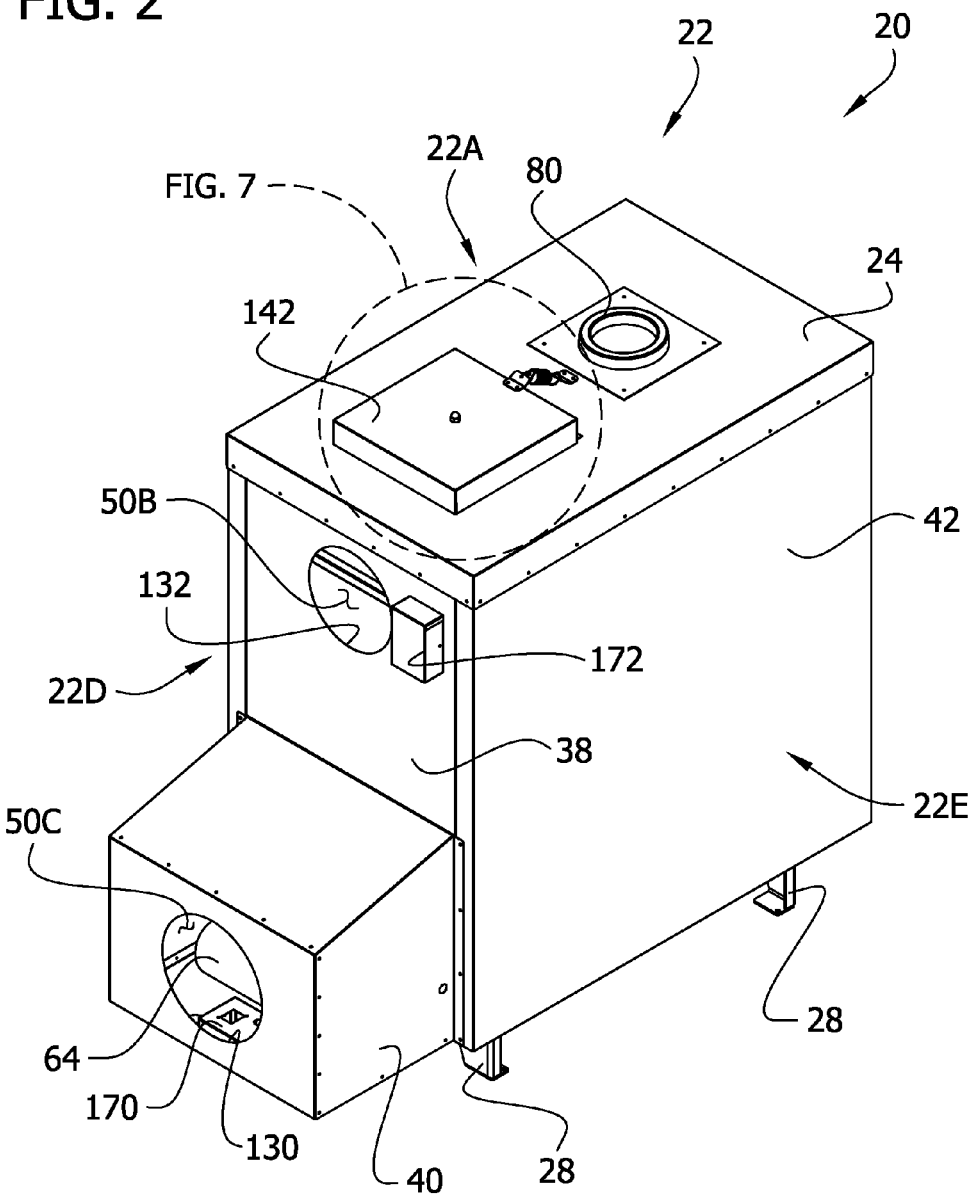
FIG. 2 is a rear perspective of the heater of FIG. 1.

Referring to FIGS. 1 and 2, the heater 20 comprises a housing generally indicated at 22. The housing 22 includes a top 22A defined in part by an upper wall 24 and a bottom 22B defined in part by a lower wall 26 from which four legs 28 extend to support the heater 20 on a surface. The housing 22 includes a front 22C defined in part by a hinged access panel 30 selectively moveable to permit access to a forward wall 32 of the housing and components of the heater discussed in more detail below. The access panel 30 is shown in an open position in FIG. 1. The housing 22 has a back 22D defined in part by a rear wall 36, a hot air plenum or chamber housing 38, and a blower housing 40. The heater housing 22 has sides 22E, 22F defined by left and right side walls 42, 44. The heater walls 24, 26, 32, 36, 42 and 44 are made of suitable material such as heavy gauge steel and may be thermally insulated. Heaters with housings having other configurations and shapes are within the scope of the present invention.

Figure 3:
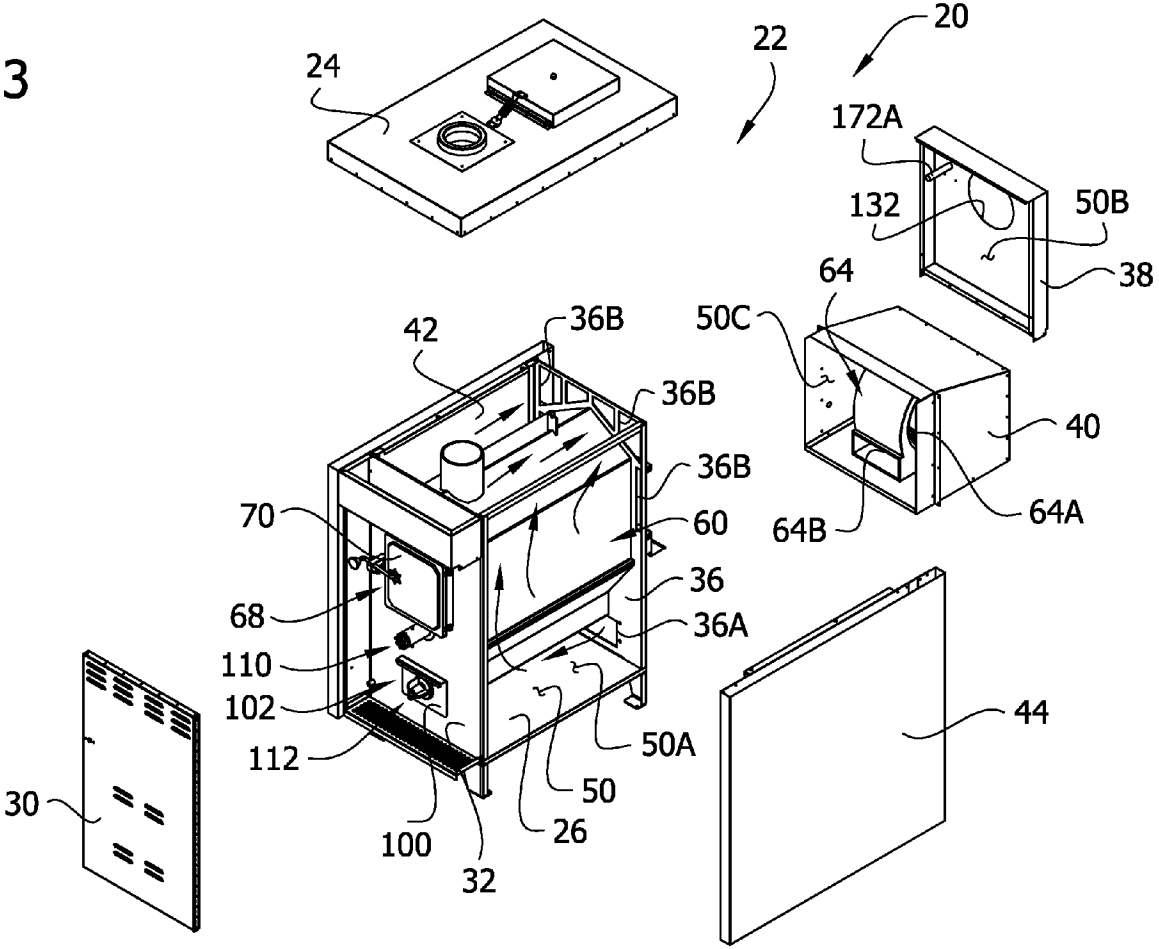
FIG. 3 is a front perspective of the heater partially separated.

Referring to FIG. 3, the housing 22 has a hollow interior 50 including a conditioning chamber 50A defined in part by the upper and lower walls 24, 26, the forward and rear walls 32, 36, and the left and right side walls 42, 44. The hollow interior 50 further includes a hot air plenum 50B defined by the hot air plenum housing 38 and the rear wall 36 and includes a cold air plenum 50C defined by the blower housing 40 and the rear wall 36. A fire box 60 in which the thermal fuel is burned is supported within the conditioning chamber 50A. As discussed in further detail below, a blower 64 within the blower housing 40 moves air over the fire box 60 to heat the air before the air is circulated to the building to heat the interior of the building.

Figure 4:
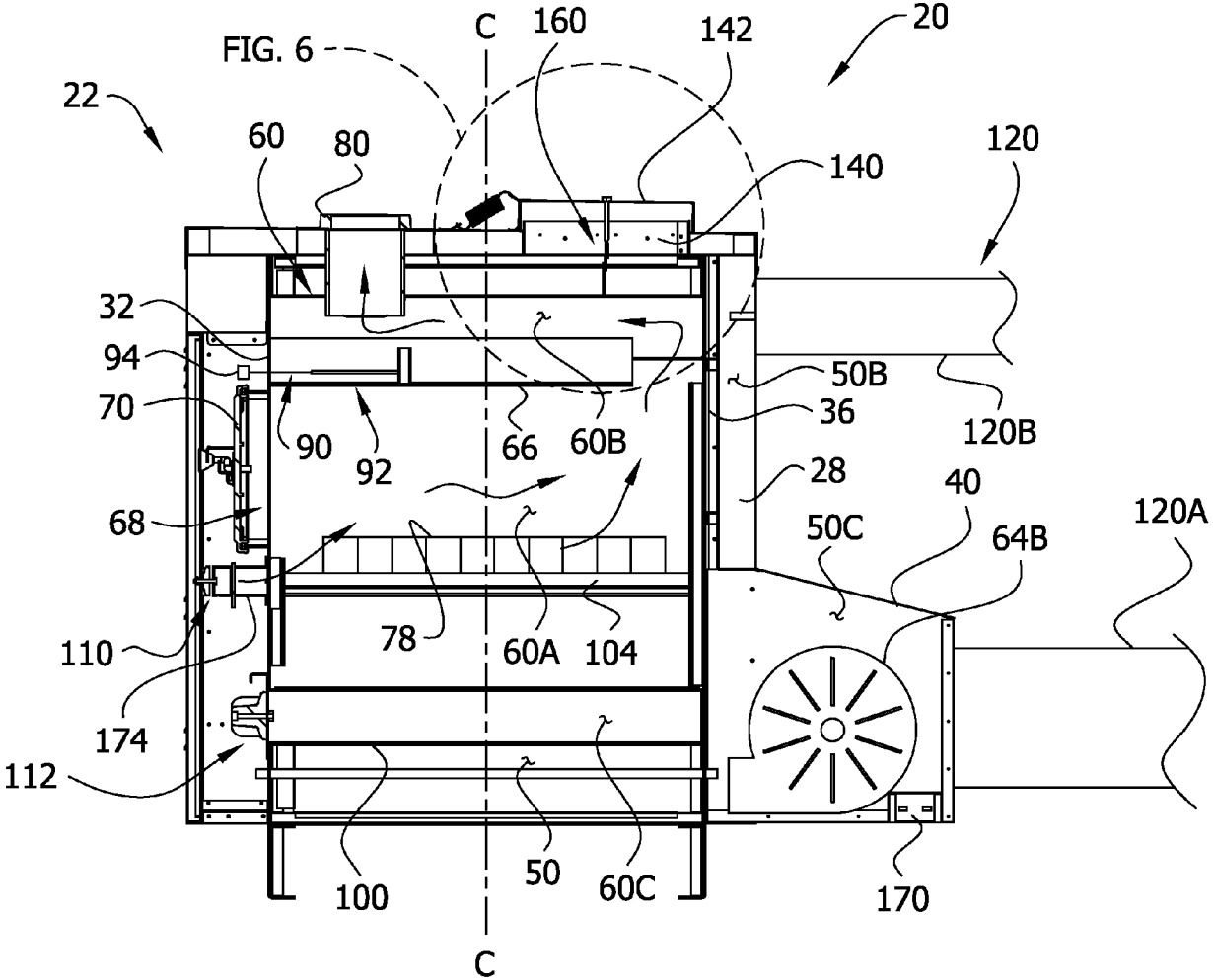
FIG. 4 is a cross section of the heater taken along line 4-4 of FIG. 1.
Figure 5:
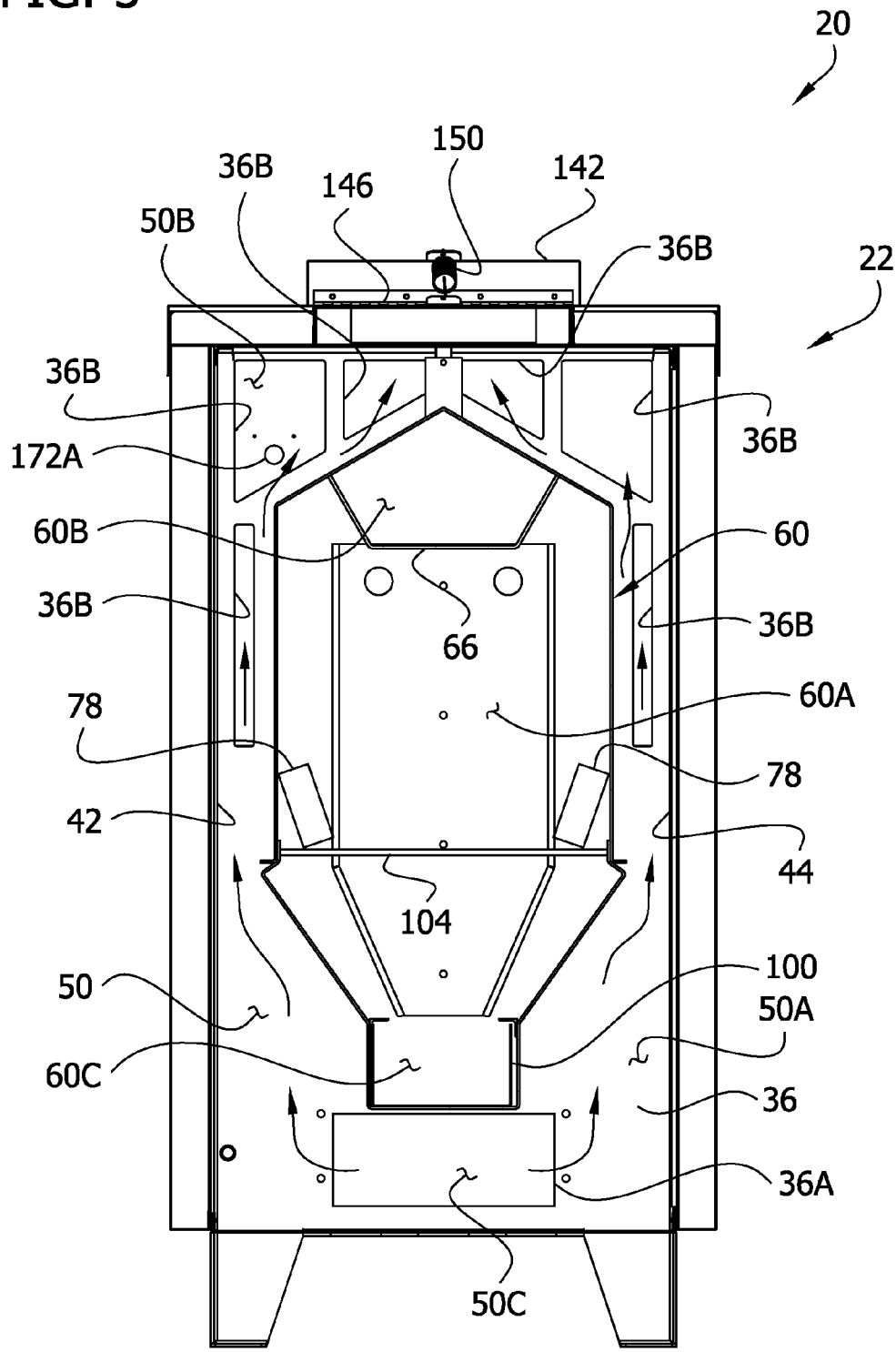
FIG. 5 is a cross section of the heater taken along the line 5-5 of FIG. 1.

As shown in FIGS. 3-5, the fire box 60 includes a combustion chamber 60A and a secondary combustion chamber 60B divided by a generally horizontal wall 66 extending from the front of the chambers 60A, 60B toward but stopping short of the rear of the chambers. Fuel such as wood is loaded into the combustion chamber 60A via a fuel opening 68 accessible through the forward wall 32 of the housing 22. A fuel door 70 is selectively moveable to open and close the fuel opening 68. The combustion chamber 60A may be lined with fire brick 78.

Flow of air and products of combustion within the fire box 60 is illustrated in FIG. 4. The burning fuel generates heat within the combustion chamber 60A. The products of combustion pass from the combustion chamber 60A along the wall 66 to the rear of the combustion chamber and to the secondary combustion chamber 60B. The products of combustion exit the housing 22 via an exhaust opening 80 in the upper wall 24 of the housing 22, to which a chimney (not shown) may be connected. The secondary combustion chamber 60B is provided to produce more efficient combustion and extend the time for heat transfer to air within the conditioning chamber 60A.

Referring to FIG. 4, the illustrated heater also includes a bypass damper 90 which in normal operation blocks a bypass opening 92 in the wall 66 between the combustion chamber 60A and the secondary combustion chamber 60B. The bypass damper 90 is moveable by pulling a knob 94 accessible outside the forward wall 32 of the housing 22 to permit direct flow of the products of combustion into the secondary combustion chamber 60B. The bypass damper 90 may moved to open the bypass opening 92, for example, when initiating a fire in the combustion chamber 60A and when loading additional fuel on a fire within the combustion chamber to prevent the products of combustion from exiting the combustion chamber through the fuel opening 68.

Referring again to FIGS. 3-5, the fire box 60 further includes an ash chamber 60C below the combustion chamber 60A sized for receiving an ash drawer 100. The ash drawer 100 is selectively moveable into and out of the ash chamber 60C via an ash opening 102 accessible through the forward wall 32 of the housing 22. Ash generated as fuel burns within the combustion chamber 60A fall into the ash drawer 100 through grates 104 lining the bottom of the combustion chamber 60A.

Fuel burning within the combustion chamber 60A is fed by oxygen passing through the forward wall 32 of the housing via a thermostatically controlled natural draft 110. The natural draft 110 includes a valve (not shown) such as a butterfly valve that is opened and closed to automatically control generation of desired heat in the combustion chamber 60A, as described in further detail below. A dampered draft 120 is also provided in the ash drawer 100 for feeding fuel burning within the combustion chamber with additional oxygen.

Figure 8:
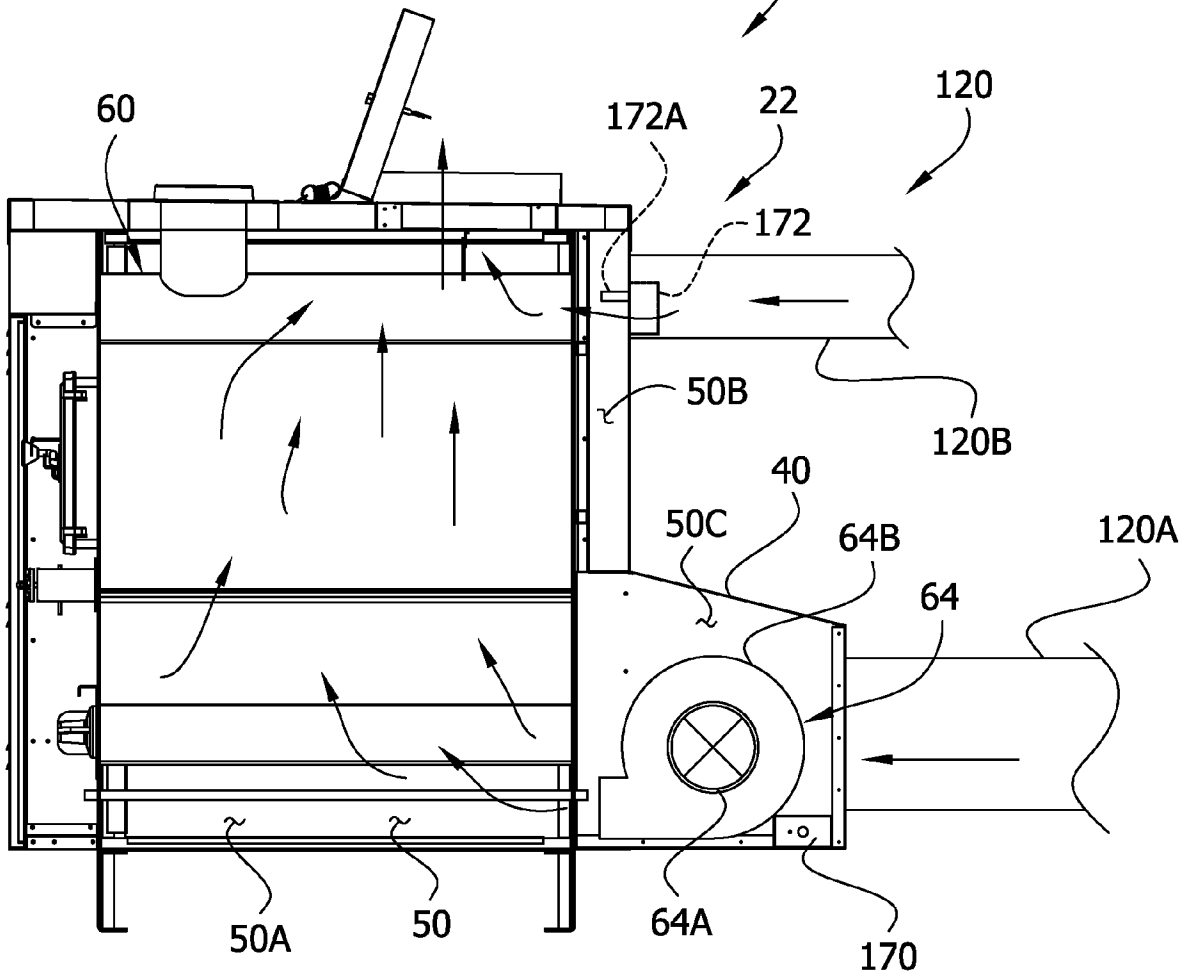
FIG. 8 is a cross section of the heater taken along the line 8-8 of FIG. 1, the heat dump cover being shown in an open position.

The heater 20 is in communication with the building via a duct system 120, a portion of which is illustrated in FIGS. 4 and 8. The duct system 120 includes a cold air duct 120A and a hot air duct 120B. The heater 20 receives relatively cool air from the building via the cold air duct 120A. This air is introduced into the heater 20 through an air inlet 130 (FIG. 2) in the blower housing 40 to which the cold air duct 120A is connected. For example, the air inlet 130 may comprise a circular opening having a diameter of approximately 12 inches, providing the inlet with a flow area of approximately 113 square inches. The heater 20 delivers hot air to the building via the hot air duct 120B. The heater 20 communicates with the hot air duct 120B via an air outlet 132 (FIG. 2) in the hot air plenum housing 38 that may comprise a circular opening having a diameter of approximately 10 inches, providing the outlet with a flow area of approximately 79 square inches. Duct systems having other configurations such as duct systems not including a cold air duct, and systems having air inlets and outlets of other sizes and shapes are within the scope of the present invention.

Air flow through the heater interior 50 is illustrated in FIGS. 3 and 5. The blower 64 moves air from the cold air plenum 50C through the conditioning chamber 50A to the building for heating the interior of the building. The illustrated blower 64, shown in FIGS. 3, 4, and 8, includes an electric motor 64A and a squirrel cage fan 64B. In one example, the blower 64 is capable of moving 1800 cubic feet of air per minute. Other types of blowers or air movers may be used. When energized, the blower 64 forces air from the cold air plenum 50C into the conditioning chamber 50A via a blower opening 36A in the rear wall 36 of the housing 22. Replacement air flows into the cold air plenum 50C from the building via the cold air duct 120A. The air within the conditioning chamber 50A is heated as it flows generally upward and over the fire box 60. Baffles (not shown) may be used to create a tortuous, and therefore longer, flow path over the fire box 60 to enhance efficiency of the heater 20. Heated air flows from the conditioning chamber 50A into the hot air plenum 50B via a plurality of openings 36B in the rear wall 36 of the housing 22. The hot air then flows to the building via the hot air duct 120B and circulates through the building in a manner that will not be described in detail herein. The heater 20 may be used as a sole source for heating the interior of the building or as a primary or secondary source in conjunction with another source such as a gas forced-air heater or furnace located within the building.

The heater 20 includes a heat dump opening 140 formed in the top 22A of the housing 22, and more particularly in the upper wall 24 of the housing, for venting or "dumping" excessively heated air (i.e., air having a temperature exceeding temperatures achieved during normal operation of the heater) from the conditioning chamber 50A to ambient. In the illustrated embodiment, the heat dump opening 140 comprises a rectangular opening having sides each approximately 12 inches long, providing the heat dump opening with a flow area of approximately 144 square inches, which is larger than the flow area of the inlet 130 (approximately 113 square inches). The heat dump opening 140 includes a peripheral flange 140A extending upward from the upper wall 24 of the housing 22. Heat dump openings positioned at different locations on the heater (e.g., different locations on the upper wall or on a side wall of the heater) and having different configurations, shapes, and sizes are within the scope of the present invention. For example, heat dump opening may be circular, and may have a flow area of approximately 100, 120, 140, 150, 160, or more square inches.

As shown in FIG. 4, the heat dump opening 140 is positioned on the upper wall 24 directly above the fire box 60 and behind a centerline C-C of the fire box. Air within the conditioning chamber 50A increases in temperature as it moves generally upward across the fire box 60 toward the top 22A of the housing and toward the openings 36B in the rear wall 36 through which the air passes into the hot air plenum 50B. The air begins to cool gradually after leaving the conditioning chamber 50A. It is desirable for the heat dump opening 140 to be in the top 22A of the heater 20, and more particularly directly above the fire box 60, because that position generally corresponds to the location at which air heated by the heater is at its highest temperature. Thus, the heat dump opening 140 is positioned to quickly and efficiently vent excessively heated air to ambient before excessively heated air can accumulate in the heater 20 or flow down the hot or cold air ducts 120A, 120B to the building, potentially causing damage to the heater, ducts, and building.

A heat dump cover 142 positioned on the outside of the heater housing 22 selectively blocks the heat dump opening 140. The cover 142 is moveable between a closed position (e.g., FIG. 6) in which the heat dump opening 140 is blocked to prevent gas (e.g., air) from exiting the hollow interior 50 of the heater 20 through the heat dump opening, and an open position (e.g., FIG. 7) in which the heat dump opening is unblocked to permit gas to exit the interior through the heat dump opening. During normal heater operation, the cover 142 is in the closed position so that air within the conditioning chamber 50A is substantially prevented from escaping to ambient through the heat dump opening 140. However, as described in further detail below, when excessively heated air is sensed in the conditioning chamber 50A, the cover 142 is moved to the open position to create direct communication between the conditioning chamber and ambient to vent the excessively heated air.

Figure 6:
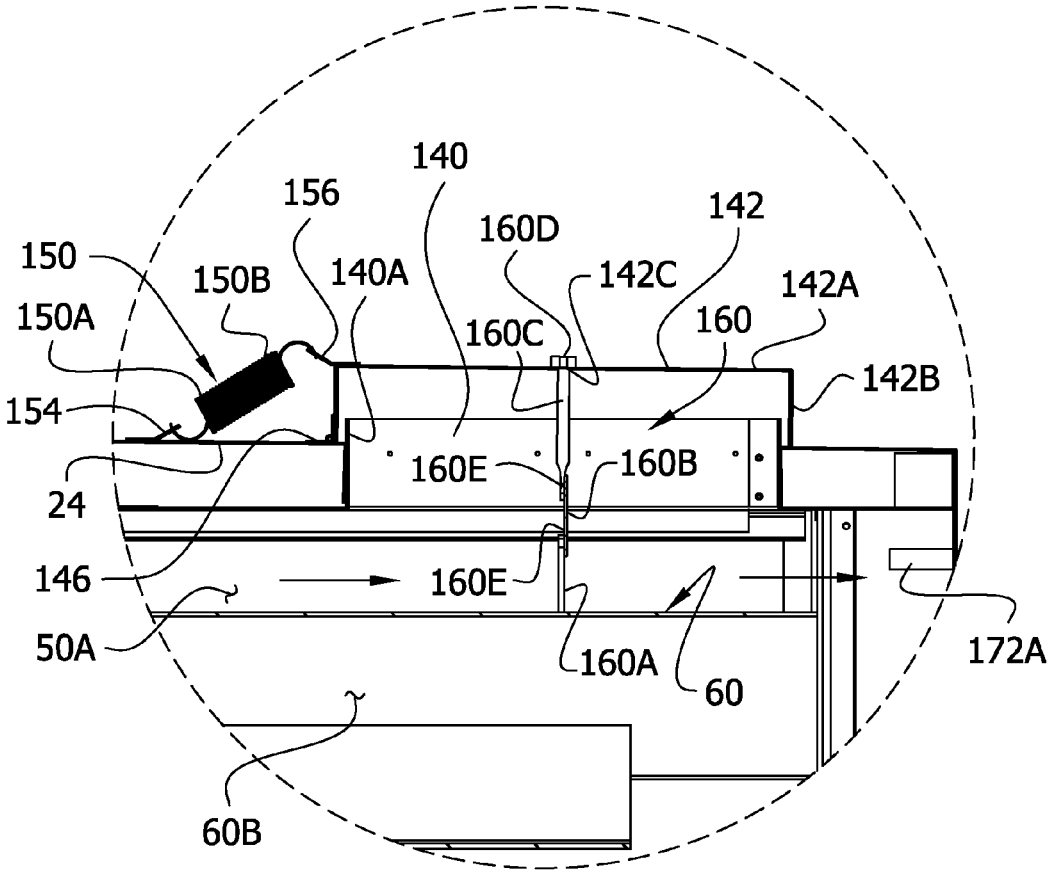
FIG. 6 is an enlarged view of a cross-section of a heat dump opening and a heat dump cover showing the heat dump cover in a closed position.
Figure 7:
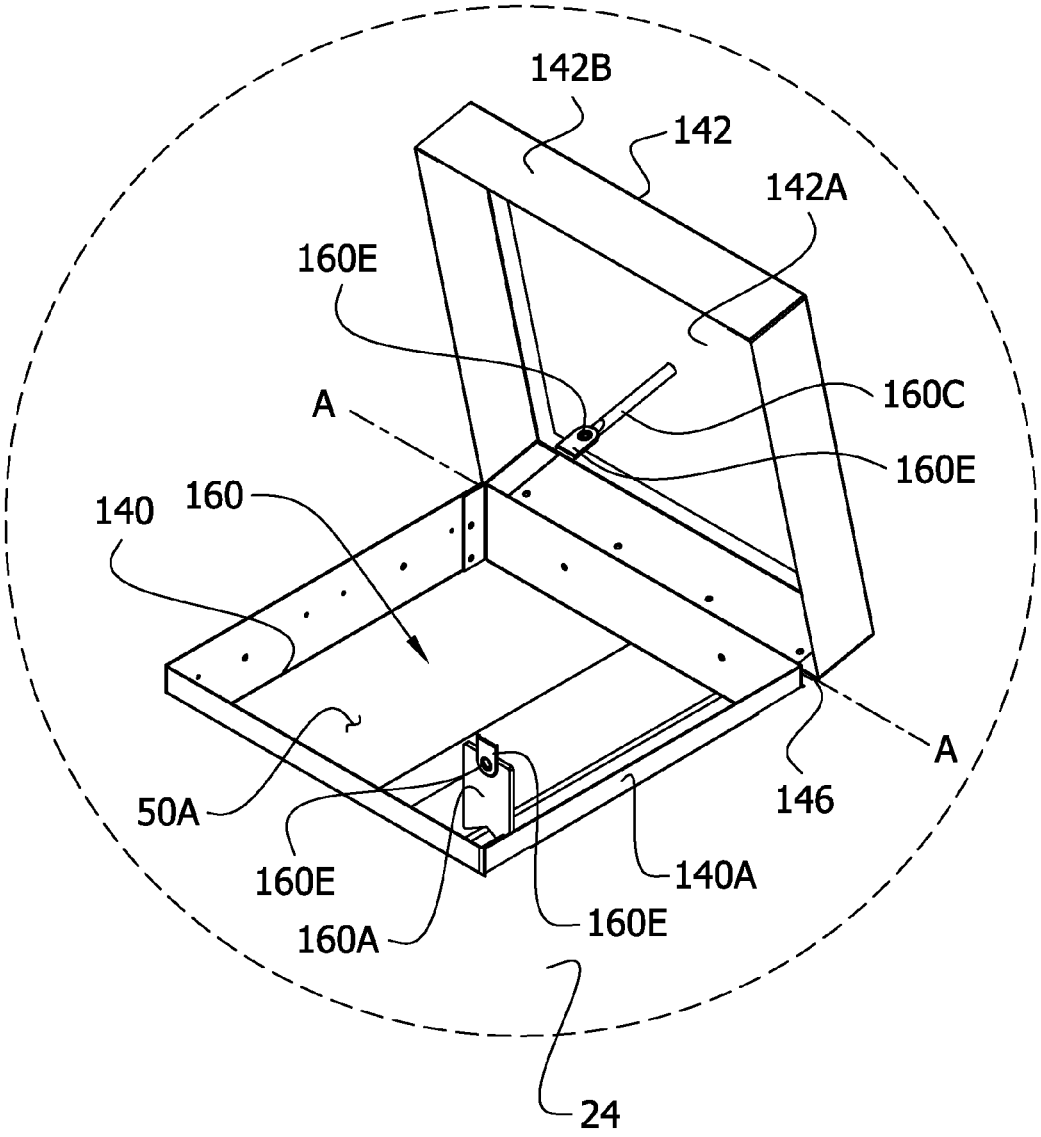
FIG. 7 is an enlarged perspective of the heat dump opening and the heat dump cover showing the heat dump cover in an open position.

Referring to FIGS. 6 and 7, the illustrated cover 142 has a rectangular main body 142A generally corresponding to the shape of the heat dump opening. A peripheral flange 142B extends downward from the main body 142A and overlaps the flange 140A of the heat dump opening 140 when the cover 142 is in the closed position, forming a seal that substantially blocks air from exiting the conditioning compartment 50A through the heat dump opening and prevents rain from entering. A suitable gasket (not shown) may be used to create an air-tight seal between the heat dump opening 140 and the heat dump cover 142. A hinge 146 connects the flange 142B to the upper wall 24 of the housing 22. The hinge 146 defines a turning axis A-A (FIG. 7) about which the cover 142 rotates to move between the open and closed positions.

As shown in FIG. 7, the heat dump cover 142 is biased toward the open position by a biasing element 150, which in the illustrated embodiment is a tension spring 150 located on the outside of the housing 22. A first end of the spring 150A is connected to the upper wall 24 of the housing 22 by a first bracket 154. A second end of the spring 150B is connected to the heat dump cover 142. The spring 150 is connected to the cover 142 in a manner so the spring applies a force to the cover tending to move the cover to the open position. In the illustrated embodiment, the spring 150 is connected to the main body 142A of the cover 142 by a second bracket 156. The spring 150 is configured to pull the cover 142 to the open position and maintain the cover in the open position. Other types of biasing elements may be used, including weights, compression springs, and springs located on the inside of the housing.

Referring to FIG. 6, the heat dump cover 142 is held in its closed position against the force of the spring 150 by a thermal latch 160. In the illustrated embodiment, the latch 160 includes a bracket 160A, a thermal sensor 160B, a threaded bolt 160C, and a nut 160D. The bracket 160A is mounted (e.g., welded) on the fire box 60 or other structure within the housing 22, and the thermal sensor 160B is connected to the bracket 160A. The bolt 160C is connected to the thermal sensor 160B and extends upward through the heat dump opening 140. The thermal sensor 160B is connected to the bracket 160A and the bolt 160C by fasteners 160E such as a pins, hooks, or clamps. In the closed position of the heat dump cover 142, the bolt 160C extends through an opening 142C in the heat dump cover 142. The nut 160D is threaded onto the bolt 160C to hold the heat dump cover 142 in the closed position. Thermal latches having different configurations are within the scope of the present invention.

The thermal sensor 160B is adapted for sensing temperature and permitting the heat dump cover 142 to move toward its open position when a temperature sensed by the thermal sensor exceeds a preselected limit temperature. In the illustrated embodiment, the thermal sensor 142 is a fusible link, also designated by 142. For example, the fusible link 142 may be made of a lead alloy or another fusible material. The fusible link 142 is configured to break at a predetermined temperature such as 370° F. Other types of fusible links and fusible links that break at other temperatures ranging from 300° F. to 450° F. (e.g., 325° F., 350° F., 380° F., 390° F., or 400° F.) may be used. When the fusible link 142 breaks, the spring 150 forces the heat dump cover 142 to the open position and holds the cover in that position. Other types of thermal sensors are within the scope of the present invention.

As shown in FIGS. 4 and 5, the thermal sensor 160B is positioned for sensing temperature directly above the fire box 60. In the illustrated embodiment, the thermal sensor 160B is positioned within the conditioning chamber 50A above the combustion chamber 60A and directly above the secondary combustion chamber 60B, behind the centerline C-C of the fire box 60 (FIG. 4). As explained above, air within the conditioning chamber 50A is heated as it moves generally upward across the fire box 60 toward the top 22A of the heater 20 and the openings 36B in the rear wall through which the air passes into the hot air plenum 50B. The air begins to cool gradually after leaving the conditioning chamber 50A. It is desirable to have the thermal sensor 160B positioned directly above the fire box 60 near the top 22A of the heater 20 because that position generally corresponds to the location at which air heated by the heater is at its highest temperature. Thus, the thermal sensor 160B is positioned to sense excessively heated air and allow the heat dump cover 142 to move to the open position before excessively heated air can accumulate in the heater 20 or flow down the hot air duct to the building, potentially causing damage to the heater, hot air duct, and building.

The heater 20 includes various electrical components for controlling operation of the heater. In particular, the heater 20 includes a main electrical control 170 (FIGS. 3 and 8) and a blower limit switch 172 (FIGS. 2 and 8). The main electrical control 170 is located within the blower housing 40 and is connected to a power source such as an electrical outlet or generator. The main electrical control 170 is in communication with a thermostat (not shown) located within the building. The blower limit switch 172 is mounted on the hot air plenum housing 38 and includes a probe 172A that extends into the hot air plenum 50B. The blower limit switch 172 is programmable (e.g., by turning a dial on the blower limit switch) to select an air temperature at which the blower 64 energizes (e.g., 170° F.) and an air temperature at which the blower de-energizes (e.g., 110° F.). The blower limit switch 172 senses these respective temperatures within the hot air plenum 50B via the probe 172A and communicates this information to the main electrical control 170 so that the main electrical control can cause the blower 64 to energize and de-energize accordingly. The electrical components of the heater 20 may also include a suitable motor 174 (FIG. 4) configured for opening and closing the natural draft 110 (e.g., by opening and closing a valve).

In operation, a fuel source such as wood is loaded in the combustion chamber 60A, and a fire is lit. When the thermostat (not shown) in the building calls for heat, the main electrical control 170 causes the natural draft 110 to open, allowing oxygen to feed the fire in the combustion chamber 60A. Thus, the fire generates more heat and heats the air in the conditioning chamber 50A. When the blower limit switch 172 senses a preselected hot air temperature (e.g., 170° F.) within the hot air plenum 50B, the main electrical control causes the blower 64 to energize to circulate the heated air to the building and draw replacement air into the conditioning chamber 50A. If the blower limit switch 172 senses a preselected cool air temperature (e.g., 110° F.) within the hot air plenum 50B, the main electrical control de-energizes the blower 64 until the blower limit switch 172 again senses the preselected hot air temperature in the hot air plenum 50B. When the thermostat senses sufficient heat in the building, the main electrical control 170 causes the natural draft 110 to close, decreasing oxygen to the fire to decrease heated air generation in the conditioning chamber 50A.

Under certain circumstances, such as power loss to the main electrical control 170, malfunction of an electrical component, or blockage of the hot air duct 120B, excessively heated air may be generated within the conditioning chamber 50A that may cause damage to the heater 20, the duct system 120, and the building. When this occurs, heat may be generated until the burning fuel within the fire box naturally dies. The air within the heater 20 may reach a temperature of approximately 1000° F. or more degrees F. The excessively heated air may accumulate in the hollow interior 50 of the heater 20, flow down the hot air duct 120B to the building, or flow up the cold air duct 120A to the building. The excessively heated air thus can cause damage the heater 20, the duct system 120, and the building. As air temperature in the heater 20 increases, the first component of the heater likely to be damaged is the blower limit switch 172, and in particular the probe 172A located in the hot air plenum 50B. The next components of the heater likely to sustain damage are the blower motor 64A and the main electrical control 170. These electrical components begin sustaining damage at a temperature of approximately 450° F. Increased temperature can also damage structural components of the heater such as the walls 24, 26, 32, 36, 42, and 44. The hot and/or cold air ducts 120A, 120B in communication with the heater 20 may be damaged at a temperature of approximately 250° F. Finally, if the excessively heated air flows to the building, the building may be damaged.

If the fusible link 160B is exposed to excessively heated air (e.g., an air temperature of approximately 370° F.), the fusible link 160B breaks, allowing the spring 150 to move the heat dump cover 142 to the open position (e.g., FIG. 7) to vent or dump the excessively heated air to ambient. As shown in FIG. 8, as heated air within the conditioning chamber 50A escapes to ambient, replacement air is drawn into the hollow interior 50 of the heater 20. The heat dump opening 140 is positioned in the housing 20 relative to the air inlet 130 and air outlet 132 such that heated air escaping the conditioning chamber 50A through the heat dump opening causes replacement air to be drawn into the hollow interior 50 of the housing from the inlet and outlet. Replacement air is drawn in though the inlet 130 from the cold air duct 120A, and replacement air is drawn in through the outlet 132 from the hot air duct 120B. The replacement air not only cools the heater 20 but also prevents heated air from flowing down the ducts 120A, 120B to the building. In particular, the replacement air flowing through the inlet 130 via the cold air duct 120A cools the main electrical control 170 and the blower 64, and the replacement air flowing through the outlet 132 via the hot air duct 120B cools the blower limit switch 172. Thus, active cooling of the heater 20 is achieved to prevent damage to the heater, the ducts 120A, 120B, and the building.

After the fire in the fire box 60 dies and the circumstances resulting in the excessively heated air are remedied, a new thermal sensor 160B is installed. The broken thermal sensor 160B is removed by disconnecting the remaining sensor pieces from the bracket 160A and the bolt 160C. The nut 160D is unthreaded from the bolt 160C, and the bolt is removed from the cover 142. A new thermal sensor 160B is connected to the bracket 160A, and the bolt 160C is mounted on the thermal sensor 160B. The cover 142 can then be moved to its closed position in which the bolt 160C extends through the cover. The nut 160D is threaded on the bolt 160C to retain the cover 142 in its closed position against the force of the spring 150. Normal operation of the heater 20 then may be restored.

Having described the invention in detail, it will be apparent that modifications and variations are possible without departing from the scope of the invention defined in the appended claims.

When introducing elements of the present invention or the preferred embodiment(s) thereof, the articles "a", "an", "the", and "said" are intended to mean that there are one or more of the elements. The terms "comprising", "including", and "having" are intended to be inclusive and mean that there may be additional elements other than the listed elements.

As various changes could be made in the above constructions, products, and methods without departing from the scope of the invention, it is intended that all matter contained in the above description and shown in the accompanying drawings shall be interpreted as illustrative and not in a limiting sense.

What is claimed is:

1. A heater for heating a fluid comprising:

a housing having:

a) a top, b) a side, c) a hollow interior defined at least in part by the top and the side, d) an inlet having a cross-sectional area smaller than the hollow interior permitting fluid to enter the interior, e) an outlet having a cross-sectional area smaller than the hollow interior permitting fluid to exit the interior, and f) a heat dump opening formed in the housing upstream from the outlet and dowstream from the inlet selectively permitting fluid to exit the hollow interior;

a fire box positioned in the hollow interior of the housing for burning a thermal source to heat fluid inside the hollow interior of the housing;

a heat dump cover selectively blocking the heat dump opening and moveable between a closed position in which the heat dump opening is blocked to prevent fluid from exiting the interior through the heat dump opening and an open position in which the heat dump opening is unblocked to permit fluid to exit the interior through the heat dump opening; and a latch operatively connected to the heat dump cover, said latch including a thermal sensor positioned within the hollow interior of the housing upstream from the outlet for sensing temperature above the fire box, said latch permitting the heat dump cover to move toward its open position when a temperature inside the hollow interior sensed by the thermal sensor exceeds a preselected limit temperature, permitting fluid to exit the hollow interior of the housing through the heat dump opening to reduce temperature increase in the interior.

2. A heater as set forth in claim 1 wherein the heat dump opening is formed in the top of the housing.

3. A heater as set forth in claim 1 wherein the preselected temperature is less than about 370° F.

4. A heater as set forth in claim 1 wherein the thermal sensor comprises a fusible link.

5. A heater as set forth in claim 1 wherein the thermal sensor is positioned directly above the fire box.

6. A heater for heating a fluid comprising:

a housing having:

a) a top, b) a side, c) a hollow interior defined at least in part by the top and the side, d) an inlet at an upstream end of the hollow interior permitting fluid to enter the interior, e) an outlet at a downstream end of the hollow interior permitting fluid to exit the interior, and f) a heat dump opening separate from the inlet and outlet formed in the top of the housing;

a fire box positioned in the hollow interior of the housing for burning a thermal source to heat fluid inside the hollow interior of the housing, at least a portion of the fire box being positioned directly below the heat dump opening;

a heat dump cover selectively blocking the heat dump opening and moveable between a closed position in which the heat dump opening is blocked to prevent fluid from exiting the interior through the heat dump opening and an open position in which the heat dump opening is unblocked to permit fluid to exit the interior through the heat dump opening, said cover being biased toward the open position; and a latch operatively connected to the heat dump cover, said latch including a thermal sensor for sensing temperature in the hollow interior, said latch permitting the heat dump cover to move toward its open position when a temperature sensed by the thermal sensor exceeds a preselected limit temperature, permitting fluid to exit the hollow interior of the housing through the heat dump opening to reduce temperature increase in the interior.

7. A heater as set forth in claim 6 wherein the heat dump opening has a flow area exceeding a flow area of the housing inlet.

8. A heater as set forth in claim 6 wherein the heat dump opening is positioned directly above the fire box.

9. A heater as set forth in claim 6 further comprising a blower limit control mounted in the hollow interior of the housing adjacent the outlet and wherein the heat dump opening is sized and positioned on the housing relative to the outlet and the blower limit control such that when the heat dump opening is in its open position heated fluid escaping the hollow interior through the heat dump opening causes reversal of flow through the outlet such that replacement fluid is drawn from the outlet to pass over the blower limit control to cool the blower limit control.

10. A heater for heating a fluid comprising:

a housing having:

a) a top, b) a side, c) a hollow interior defined at least in part by the top and the side, d) an inlet formed in the housing permitting fluid to enter the interior, e) an outlet formed in the housing permitting fluid to exit the interior, and f) a heat dump opening formed in the housing separate from the inlet and outlet;

a fire box positioned in the hollow interior of the housing for burning a thermal source to heat fluid inside the hollow interior of the housing;

a heat dump cover selectively blocking the heat dump opening and moveable between a closed position in which the heat dump opening is blocked to prevent fluid from exiting the interior through the heat dump opening and an open position in which the heat dump opening is unblocked to permit fluid to exit the interior through the heat dump opening; and a latch operatively connected to the heat dump cover, said latch including a thermal sensor for sensing temperature in the hollow interior, said latch permitting the heat dump cover to move toward its open position when a temperature sensed by the thermal sensor exceeds a preselected limit temperature, permitting fluid to exit the hollow interior of the housing through the heat dump opening to reduce temperature increase in the interior;

wherein the heat dump opening is sized and positioned on the housing relative to the outlet such that when the heat dump cover is in its open position, heated fluid escaping the hollow interior through the heat dump opening causes replacement fluid to be drawn into the hollow interior from the outlet.

11. A heater as set forth in claim 10 further comprising a blower limit control mounted in the hollow interior of the housing adjacent the outlet and wherein the heat dump opening is sized and positioned on the housing relative to the outlet and the blower limit control such that when the heat dump cover is in its open position heated fluid escaping the hollow interior through the heat dump opening causes reversal of flow through the outlet such that replacement fluid is drawn from the outlet to pass over the blower limit control to cool the blower limit control.

12. A heater for heating a fluid comprising:

a housing having a top, a side, a hollow interior defined at least in part by the top and the side, an inlet permitting fluid to enter the interior, an outlet permitting fluid to exit the interior, and a heat dump opening formed in the housing;

a blower limit control mounted in the hollow interior of the housing adjacent the outlet;

a main electrical control mounted in the hollow interior of the housing adjacent the inlet;

a fire box positioned in the hollow interior of the housing for burning a thermal source to heat fluid inside the hollow interior of the housing;

a heat dump cover selectively blocking the heat dump opening and moveable between a closed position in which the heat dump opening is blocked to prevent fluid from exiting the interior through the heat dump opening and an open position in which the heat dump opening is unblocked to permit fluid from exiting the interior through the heat dump opening; and a latch operatively connected to the heat dump cover, said latch including a thermal sensor for sensing temperature in the hollow interior, said latch permitting the heat dump cover to move toward its open position when a temperature sensed by the thermal sensor exceeds a preselected limit temperature, permitting fluid to exit the hollow interior of the housing through the heat dump opening to reduce temperature increase in the interior, said fluid exiting the hollow interior of the housing through the heat dump opening drawing replacement fluid into the hollow interior through the inlet to cool the main electrical control and through the outlet to cool the blower limit control.

13. A heater as set forth in claim 12 wherein said latch includes a thermal sensor positioned for sensing temperature directly above the fire box.

14. A heater as set forth in claim 13 wherein the heat dump opening is formed in the top of the housing.

15. A heater as set forth in claim 14 further comprising a spring connected to the heat dump cover for biasing the cover toward the open position.

16. A heater as set forth in claim 12 wherein the heat dump opening is formed in the top of the housing.

17. A heater as set forth in claim 16 further comprising a spring connected to the heat dump cover for biasing the cover toward the open position.

18. A heater as set forth in claim 12 further comprising a spring connected to the heat dump cover for biasing the cover toward the open position.

19. A heater as set forth in claim 18 wherein said latch includes a thermal sensor positioned for sensing temperature directly above the fire box.

20. A wood heater for heating air comprising:

a housing having a top, a side, a hollow interior defined at least in part by the top and the side, an inlet permitting air to enter the interior, an outlet permitting air to exit the interior, and a heat dump opening formed in the housing;

a fire box positioned in the hollow interior of the housing for burning wood to heat air inside the hollow interior of the housing;

a heat dump cover selectively blocking the heat dump opening and moveable between a closed position in which the heat dump opening is blocked to prevent air from exiting the interior through the heat dump opening and an open position in which the heat dump opening is unblocked to permit air to exit the interior through the heat dump opening;

a latch operatively connected to the heat dump cover, said latch including a thermal sensor positioned for sensing temperature directly above the fire box, said latch permitting the heat dump cover to move toward its open position when a temperature sensed by the thermal sensor exceeds a preselected limit temperature, permitting air to exit the hollow interior of the housing through the heat dump opening to reduce temperature increase in the interior;

a blower limit control mounted in the hollow interior of the housing adjacent the outlet:

a main electrical control mounted in the hollow interior of the housing adjacent the inlet;

wherein said heat dump opening is sized so that fluid exiting the the hollow interior of the housing through the heat dump opening draws replacement fluid into the hollow interior through the inlet to cool the main electrical control and through the outlet to cool the blower limit control.

* * * * *